US005233120A

United States Patent [19]

Minkkinen et al.

[11] Patent Number: 5,233,120

[45] Date of Patent: Aug. 3, 1993

[54] PROCESS FOR THE ISOMERIZATION OF $C_5/C_6$ NORMAL PARAFFINS WITH RECYCLING OF NORMAL PARAFFINS

[75] Inventors: Ari Minkkinen, St Nom La Breteche; Larry Mank, Orgeval; Sophie Jullian, Boulogne, all of France

[73] Assignee: Institut Francais Du Petrole, Reuil Malmaison, France

[21] Appl. No.: 914,348

[22] Filed: Jul. 17, 1992

[30] Foreign Application Priority Data

Jul. 18, 1991 [FR] France ..... 91 09215

[51] Int. Cl.[5] ..... C07C 5/13

[52] U.S. Cl. ..... 585/737; 585/738; 585/739; 585/741; 585/751

[58] Field of Search ..... 585/737, 738, 739, 741, 585/751

[56] References Cited

U.S. PATENT DOCUMENTS

| | | | |
|---|---|---|---|
| 2,834,823 | 5/1958 | Patton et al. | 585/738 |
| 2,918,511 | 12/1959 | Carter et al. | 585/738 |
| 2,966,528 | 12/1960 | Haensel | 260/666 |
| 3,150,205 | 9/1964 | Krane et al. | 585/738 |
| 4,210,771 | 7/1980 | Holcombe | 585/701 |
| 5,043,525 | 8/1991 | Halzmann et al. | 585/737 |

FOREIGN PATENT DOCUMENTS 876730 9/1961 United Kingdom .

*Primary Examiner*—Anthony McFarlane
*Assistant Examiner*—Nhat D. Phan
*Attorney, Agent, or Firm*—Millen, White, Zelano & Branigan

[57] ABSTRACT

The isomerization of $C_5/C_6$ n-paraffins to isoparaffins, comprises:

a stage (1) of deisopentanizing a charge constituted by a light naphtha, a stage (2) of isomerizing the deisopentanization residue, an adsorption stage (3) carried out by passing the isomerization effluent onto an adsorbent retaining the n-paraffins and alternating with the adsorption stage (3), a desorption stage (4) carried out by lowering the pressure and stripping by means of an isopentane-rich gas flow from the deisopentanization stage.

The isomerate freed from the n-paraffins in stage (3) is a product having a high octane number.

17 Claims, 2 Drawing Sheets

PROCESS FOR THE ISOMERIZATION OF $C_5/C_6$ NORMAL PARAFFINS WITH RECYCLING OF NORMAL PARAFFINS

BACKGROUND OF THE INVENTION

This invention relates to a process for the isomerization of n-paraffins to isoparaffins, with the particular aim of improving the octane number of certain petroleum fractions and more particularly those containing normal hexanes and pentanes, as well as branched hexanes and pentanes ($C_5/C_6$ fractions).

Existing processes for the isomerization of $C_5/C_6$ hydrocarbons using platinum catalysts of the chlorinated alumina type with a high activity operate on a once through basis, or with partial recycling, following fractionation of the unconverted n-paraffins, or with a total recycling after passing onto systems of molecular sieves in the liquid phase.

Although the once through process is simple, it is ineffective in increasing the octane number. To obtain high octane numbers, it is necessary to recycle constituents having a low octane number, after passing either into separating columns (e.g. a deisohexanizer) or onto molecular sieves, in the liquid or vapour phase.

A known isomerization process using molecular sieves for the vapour phase separation of the unconverted n-paraffins integrates the molecular sieve stage with the reaction stage. This is the so-called total isomerization process (or TIP), e.g. described in U.S. Pat. No. 4,210,771. It combines the use of an isomerization reactor supplied by the mixture of the charge, a desorption effluent and hydrogen and the use of a separating section by adsorption of the n-paraffins on the molecular sieve, desorption being carried out by hydrogen stripping. In such a process, the reaction system cannot consist of a high activity chlorine-containing alumina stage, due to the risks of contamination by hydrochloric acid of the integrated molecular sieves. Use is then made of a catalyst system having lower performance characteristics and which is based on zeolite and which does not use chlorine. This leads to a product having an octane number lower by 1 to 2 points than that which would have been obtained with a chlorinated alumina-based catalyst.

Thus, it is known that the lower the isomerization temperature, the higher the conversion of n-paraffins into isoparaffins and moreover the better the conversion of low octane number $C_6$ isomers (methyl pentanes) into higher octane number $C_6$ isomers (dimethyl butanes). It is also known that the platinum-impregnated, chlorinated alumina-based catalyst makes it possible to perform the isomerization reaction at a lower temperature than more stable, unchlorinated zeolite-type catalysts.

It was therefore of particular interest to conceive a process able to combine a low temperature reaction system (to have the optimum once through octane number rise) and a system of recycling the low octane number constituents of a non-integrated or chlorine-resistant nature.

It is possible to consider conventional system using separating columns (deisopentanizer and deisohexanizer), because the separating columns, can be immunized against chlorine contamination. However, such systems require a large amount of equipment and consume large quantities of energy, so that they are expensive to operate. A system having a single separating column (the deisohexaner only) would be less expensive, but would not be able to convert all the normal pentane into ispentane and would not therefore make it possible to obtain the increases in the octane number of diagrams using recycling.

To avoid contamination by chlorine of the molecular sieves used for separation, it is possible to consider an unintegrated system having a stage of stabilizing the isomerization effluent before supplying it to the adsorption stage. This idea was proposed in the so-called "PENEX MOLEX" combined process, in which the $C_5/C_6$ hydrocarbons are isomerized in a chlorinated alumina catalytic reaction, followed by adsorption on a liquid phase molecular sieve of the normal paraffins from the bottom of the stabilizer and at the bottom temperature.

The use of a molecular sieve in liquid phase adsorption and desorption is more difficult than in the vapour phase. Thus, the ratio of the quantities of adsorbed normal paraffins to the isoparaffin quantities present in the mobile phase clearly favours vapour phase operation.

Another obstacle to the use of high activity catalyst systems is their sensitivity to the contaminants of the charge, namely sulphur and water. The liquid charge and the hydrogen top-up must be freed from sulphur and dehydrated prior to introduction into the reaction system. In the present state of the art using chlorinated alumina-based catalyst systems, the charges are dried in pretreatment operations using molecular sieves.

SUMMARY OF THE INVENTION

The object of the invention is to propose a novel process making it possible to bring about a maximum increase of the octane number of a petroleum fraction containing normal paraffins, whilst limiting energy costs.

The present invention makes it possible to obviate the disadvantages of the known processes, by combining the high activity system e.g. using a catalyst consisting of a platinum-impregnated chlorinated alumina with an original adsorption-desorption system on a molecular sieve in the vapour phase (unintegrated system). Moreover, the desorption of the n-paraffins takes place under advantageous conditions from the energy standpoint by combining a pressure drop and a stripping operation using an isopentanerich vapour.

In order to supply the isopentane-rich vapour eluant for the desorption cycle, upstream of the system is incorporated a deisopentanization column, which also fulfils the following functions:

the elimination of the isopentane present in the charge, which makes it possible to reduce the charge quantity to be treated in the isomerization stage and consequently the necessary capacity for the reactor and also protects against cracking the thus eliminated isopentane, which results in an improvement in the high octane number petroleum yield of the overall process, the dehydration of the charge, which eliminates a special dehydration stage and the recovery of the desorbed n-paraffins with the isopentanerich vapours, which ensures an effective recycling of the n-paraffins to the isomerization stage, as the residue of the deisopentanization stage.

Moreover, the careful use of the isopentane supplied by the deisopentanization in the desorption stage makes it possible to eliminate the need for a purging stage at the end thereof. Thus, the adsorbent column then filled with isopentane can be immediately reused in adsorption, the effluent of the adsorption then containing no n-paraffins, even at the start thereof. This leads to a significant simplification of the unit, making it possible to use a system only containing two adsorbent beds, each operating alternately in adsorption and desorption.

According to another feature of the invention, it is possible to use a system of recompressing the overhead vapours of the deisopentanizer (heat pump) for supplying all the reboiling energy of the deisopentanizer by the condensation of the recycling product and its clear distillate. The heat pump compressor can also provide the motive force for recirculating the fraction of the isopentane-rich overhead flux necessary for the desorption of the molecular sieve.

BRIEF DESCRIPTION OF THE DRAWINGS

The process according to the invention is described in greater detail hereinafter relative to the drawings, wherein show.

DETAILED DESCRIPTION OF TRE PREFERRED EMBODIMENTS

Figure 1:
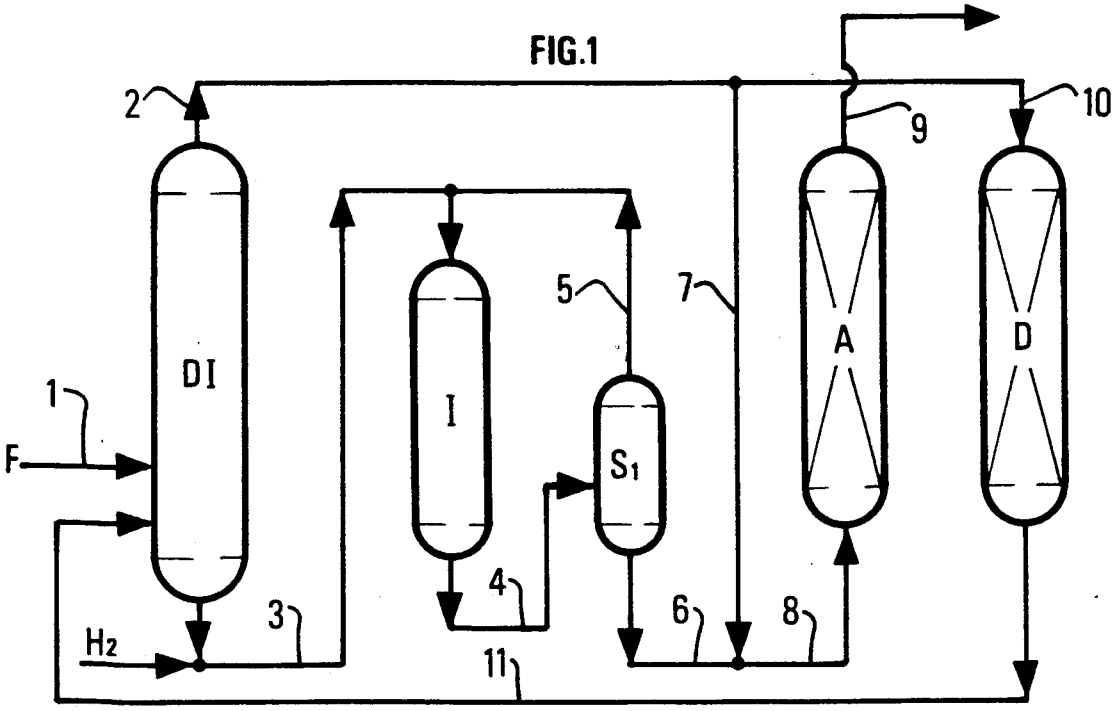
FIG. 1 a basic schematic flowsheet of the invention.

A description will be given of the isomerization of a light naphtha charge containing a preponderant proportion of $C_5$ and $C_6$ hydrocarbons in a high octane number isomerate.

The process according to the invention essentially comprises a deisopentanization stage (DI) or (1), an isomerization stage (I) or (2), a adsorption stage (A) or (3) and a desorption stage (D) or (4). In stage (1), the deisopentanization column is supplied by means of a wet $C_5/C_6$ light naphtha charge using lines 1 and 11 using the effluent from the desorption stage (4), which will be described in greater detail hereinafter, e.g. at a pressure of 1 to 2 bars (absolute pressure).

The deisopentanization column generally consists of a distillation column having internal fractionating means (structured packing or trays). The deisopentanization operation subdivides the charge into an isopentane-rich distillate, e.g. containing 5 to 20 mole % of n-pentane, and an isopentane-depleted residue, e.g. containing 5 to 15 mole % of isopentane.

Prior to introduction into the deisopentanization column, the charge can be preheated, e.g. to 30° to 60° C., optionally by heat exchange with the isomerate from the adsorption stage (3) in the exchanger $E_1$. The deisopentanization column generally operates between a bottom temperature of 40° to 90° C. and a head temperature of 20° to 60° C. The hot deisopentanization residue leaving by line 3 is then supplied to the isomerization reactor.

The overhead vapours (distillate) leaving by the line 2 are generally compressed in a compressor (heat pump) to an adequate pressure (5 to 6 bars) to enable them to condense at a temperature higher by 10° to 25° than the temperature required for the reboiling of the bottom of the column. The condensation of these vapours supplies the energy required for the reboiler by means of the exchanger $E_2$, whilst obviating the need from an additional external energy supply. Condensation largely takes place in this way, which makes it possible to economize on the cooling means necessary for the total condensation of the reflux and the distillate. The condensate is partly recycled to the head of the deisopentanizer (reflux) and partly supplied by pumping and after vaporization to the adsorption stage (3) by the line 7.

In stage (2), into an isomerization zone I is supplied the residue brought by line 3 from the deisopentanization stage (1), by pumping at the pressure of the isomerization reaction, e.g. 5 to 30 bars. The isomerization reaction is performed at a temperature of 140° to 300° C. in the presence of oxygen. The residue to be treated is mixed with a hydrogen make-up and possibly a recycled hydrogen product arriving by the line 5. It is then heated to, e.g., 140° to 300° C. by means of the charge/effluent heat exchange in the exchanger $E_3$ and a final heating in an oven H.

The isomerization reaction is preferably performed on a high activity catalyst, e.g. a catalyst based on chlorinated alumina and platinum, operating at low temperature, e.g. between 130° and 220° C., at high pressure, e.g. 20 to 35 bars, and with a low hydrogen/hydrocarbon molar ratio, e.g. between 0.1:1 and 1:1. Usable known catalysts are e.g. constituted by a high purity $\gamma$ and/or $\eta$ alumina support containing 2 to 10% by weight chlorine, 0.1 to 0.35% by weight platinum and optionally other metals. They can be used at a space velocity of 0.5 to 10 $h^{-1}$ and preferably 1 to 4 $h^{-1}$. The maintaining of the degree of chlorination of the catalyst generally makes it necessary to continuously top up with a chlorine-containing compound, such as carbon tetrachloride, injected mixed with the charge at a concentration of 50 to 600 parts per million by weight.

Obviously, it is also possible to use other known catalysts such as those constituted by a mordenite-type zeolite containing one or more metals, preferably from group VIII of the periodic classification of elements. One known catalyst consists of a mordenite having a $SiO_2/Al_2O_3$ ratio between 10 and 40, preferably 15 and 25 and containing 0.2 to 0.4% by weight platinum. However, within the scope of the inventive process, catalysts belonging to this group are less interesting than those based on chlorinated alumina, because they operate at a higher temperature (240° to 300° C.) and lead to a less pronounced conversion of normal paraffins into isoparaffins with a high octane number.

Under these conditions, part of the n-paraffins is transformed into isoparaffins. However, in the effluent leaving the isomerization reactor by the line 4, there remains a significant proportion of n-paraffins, which can extend to approximately 30 mole % and which is preferably between 15 and 25 mole %.

After cooling, the effluent of the isomerization stage (2) can pass into a separator $S_1$, whose vapour is recycled by the line 5 to the intake of the isomerization reactor 1 and the liquid effluent (isomerate) leaving by the line 6 is vaporized in the exchanger $E_4$ before being supplied to the adsorption stage (3).

Before being introduced into the adsorber A by the line 8, said isomerate is mixed with a flow consisting in that part of the condensate resulting from the condensation of the distillate of the deisopentanization stage (1) not recycled to the head of the deisopentanizer, said flux e.g. being vaporized by heat exchange in the exchanger $E_5$ with the vapour effluent of the adsorber A, which is at least partly condensed; said flow arriving by the line 7.

In the adsorption stage (3), the thus formed vapour mixture is passed in a rising flow into the adsorber A, in which are retained the n-paraffins. The isomerate from which the n-paraffins have been removed leaves by the line 9 and can be at least partly condensed in the exchanger $E_5$ and then in the exchanger $E_1$. It can also be cooled in the exchanger $E_6$.

The adsorbent bed is generally constituted by a zeolite-based molecular sieve able to selectively adsorb n-paraffins and having an apparent pore diameter of 5 Å, the 5 A zeolite being perfectly suitable for this use having a pore diameter close to 5 Å and a high adsorption capacity for n-paraffins. However, it is also possible to use other adsorbents such as chabazite or erionite. The preferred operating conditions are a temperature of 200 to 400° C. and a pressure of 10 to 40 bars. The adsorption cycle generally lasts 2 to 10 minutes. The effluent collected at the outlet of the adsorber A by the line 9 virtually only contains isoparaffins (isopentane and isohexane). As stated hereinbefore, it is condensed e.g. by heat exchange. Once cooled, e.g. by heat exchange with the charge supplying the deisopentanization stage (1), it constitutes the end product (isomerate) of the process according to the invention.

Figure 2:
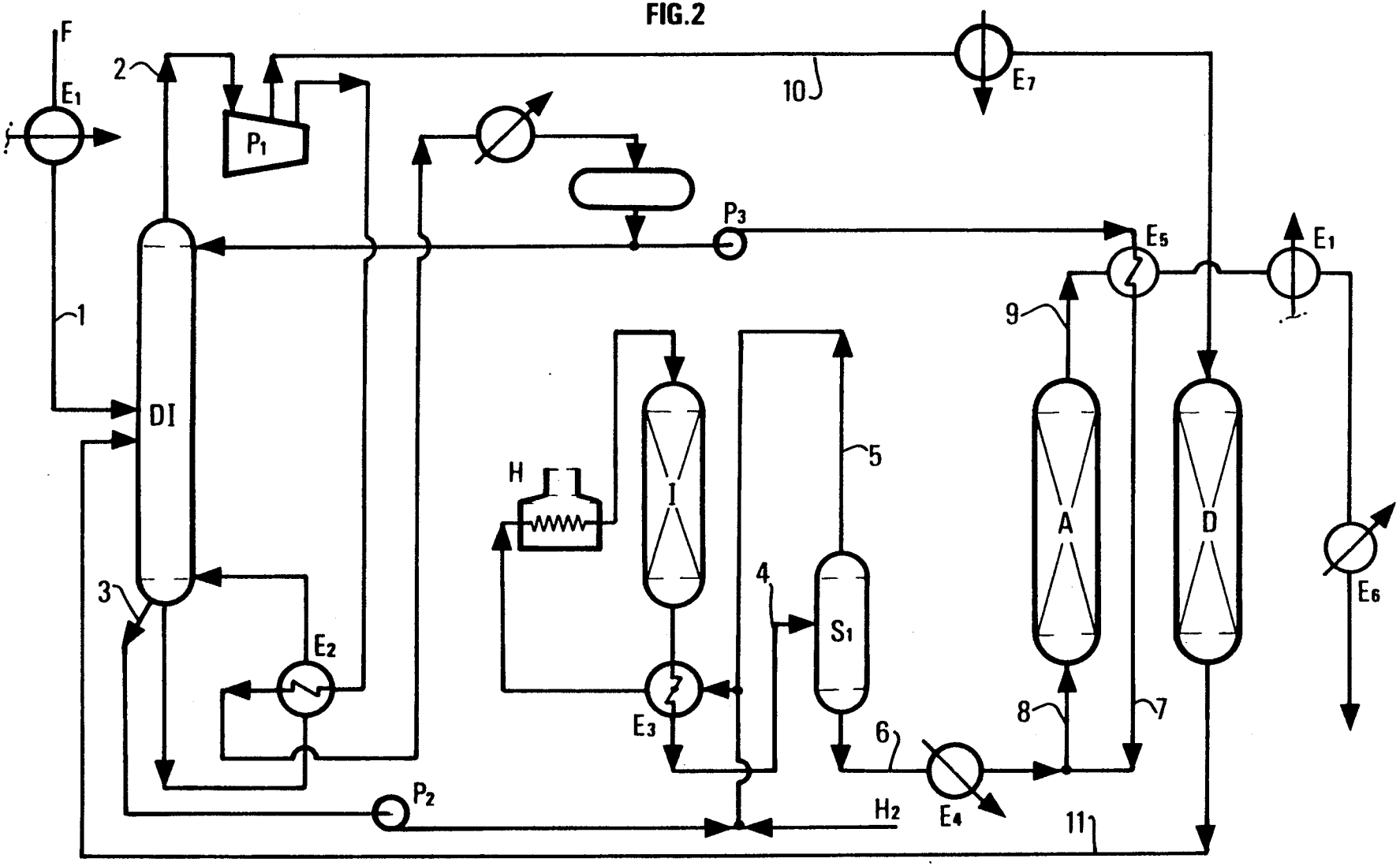
FIG. 2 a more detailed flowsheet of the process according to the invention.

The n-paraffins adsorbed during stage (3) are then desorbed in the desorption stage (4) represented in FIG. 2 by the adsorber D, which is only the adsorber A saturated with n-paraffins and operating in the desorption mode. The operation is carried out by lowering the pressure to a value below 5 bars and preferably below 3 bars and by stripping by means of an isopentane-rich gas flow, e.g. drawn off at an appropriate pressure level of the compressor of the heat pump $P_1$ traversing the adsorber D in a downward flow by the line 10. This gas flow is generally raised to a temperature of 250° to 350° C. in the exchanger $E_7$. The proportion of isopentane-rich flow necessary for the desorption advantageously corresponds to 1 to 2 moles of isopentane per mole of n-paraffins to be desorbed. The operation generally lasts 2 to 10 minutes. The effluent of the desorption stage (4) is recycled to the deisopentanization stage by the line 11. It is introduced into the deisopentanization column at a lower level than that of the supply of the fresh charge or mixed with the latter. After desorption, the adsorber D is again used in the adsorption mode.

According to a preferred variant of the process according to the invention, particularly when use is made of a chlorinated alumina-based catalyst, between the isomerization stage (2) and the adsorption stage (3) is introduced a stage of stabilizing the isomerization effluent and which essentially serves to eliminate the hydrochloric acid coming from the catalyst at the same time as the hydrogen and the light $C_1$ to $C_4$ hydrocarbons.

After cooling, e.g. by heat exchange with the charge supplying the reactor in the exchanger $E_3$, the effluent of the isomerization reactor consisting of a two-phase mixture is supplied by the line 4 directly into a stabilizing column $S_2$ generally operating at a pressure of 10 to 20 bars and advantageously at approximately 15 bars. The stabilizer $S_2$ is diagrammatically shown in FIG. 3.

At the head or top, the stabilizer eliminates the lightest products, as well as the possible hydrogen excess passing out through the line 12. The distillate is partly condensed by cooling with water in the exchanger $E_8$ and the condensate obtained can be at least partly recycled to the head of the stabilizer by the line 13, the pump $P_4$ and the line 14. If desired, it is also possible to collect a LPG as clear distillate by the line 15.

The hydrochloric acid which may be present (when the isomerization catalyst is based on platinum-impregnated chlorinated alumina) is sufficiently volatile to pass entirely into the head of the stabilizer and is discharged with the gaseous products by the line 12. The stabilizer bottom product, which is free from hydrochloric acid, is drawn off by the line 6 in the form of a vapour flow at the pressure of the stabilizer and is supplied to the adsorber following a complementary heating in the exchanger $E_4$.

The reboiler of the stabilizer is therefore used for vaporizing the charge of the adsorber A, at a temperature of approximately 150° to 200° C., permitting the vapour phase supply of the latter.

Figure 3:
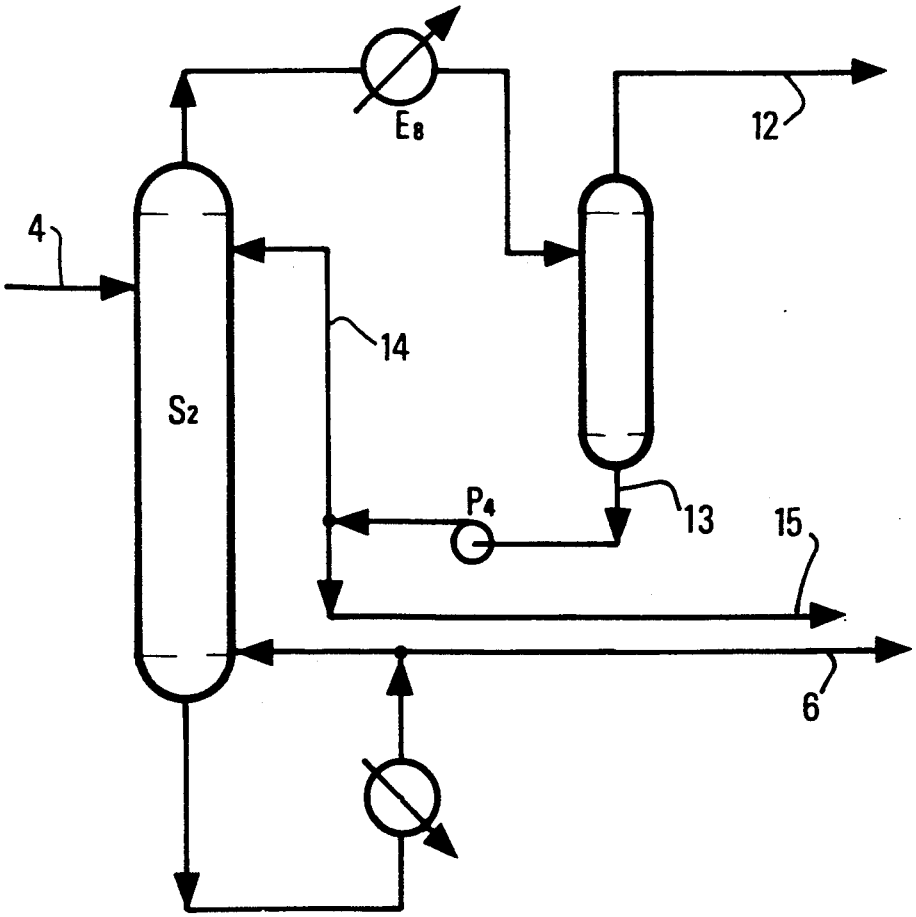
FIG. 3 a detailed flowsheet of the stabilization stage.

According to another variant of the process, the stabilizer $S_2$ shown in FIG. 3 is supplied by the bottom liquid of the separator $S_1$ using the line 6.

The process according to the invention makes it possible to obtain from $C_5/C_6$-rich light naphtha charges having a research octane number (RON) of 65 to 75, an isomerate having a RON of 87 to 91.

The following non-limitative example illustrates the invention.

EXAMPLE

The process according to the invention is performed in a pilot installation corresponding to the simplified diagram of FIG. 1 and modified by the diagram of FIG. 3. The separator $S_1$ is therefore replaced by the stabilizing column $S_2$ and there is no recycling of hydrogen to the isomerization reactor 1. The charge F is constituted by a previously desulphurized light naphtha having the following molar composition:

| Constituent | Mole % |
|---|---|
| Isobutane ($iC_4$) | 0.4 |
| Normal butane ($nC_4$) | 2.4 |
| Isopentane ($iC_5$) | 21 |
| Normal pentane ($nC_5$) | 29 |
| Cyclopentane (CP) | 2.2 |
| 2-2 dimethyl butane (22 DMB) | 0.5 |
| 2-3 dimethyl butane (23 DMB) | 0.9 |
| 2 methyl pentane (2 MP) | 12.7 |
| 3 methyl pentane (3 MP) | 10 |
| Normal hexane ($nC_6$) | 14 |
| Methyl cyclopentane (MCP) | 5 |
| Cyclohexane (CH) | 0.5 |
| Benzene | 1.3 |
| $C_7$+ | 0.1 |

Its sulphur content is 0.5 ppm by weight, its water content 500 ppm by weight and its research octane number (RON) is 70.2.

The liquid charge is introduced by the pipe 1 into the distillation column D1 at a rate of 77.6 kg/h. Simultaneous injection takes place into the column at an average flow rate of 46.8 kg/h of a recycling flow from the desorption zone D and using the line 11. The column, filled with a structured packing having an efficiency of approximately 40 theoretical plates, operates under a head pressure of 2 bars with a reflux ratio of 6 compared with the clear distillate. The round-bottomed reflux flask is equipped with a settler making it possible to discharge an aqueous phase at the lowest point. Using the line 2, at the head are drawn off 39.8 kg/h of $iC_5$-rich distillate and containing on average 6.9 mole % of $nC_5$, and at the bottom 84.6 kg/h of liquid containing 12 mole % of $iC_5$, 39.7 mole % of $nC_5$ and 17.5 mole % of $nC_6$. The water content of the bottom liquid is between 0.1 and 0.5 ppm by weight.

The bottom liquid taken up by a pump is supplied by the line 3 to the isomerization reactor 1 following a hydrogen make-up and preheating to a temperature of 140° C. under a pressure of 30 bars. The reactor contains 52 liters of a $\eta$ alumina-based isomerization catalyst containing 7% by weight chlorine and 0.23% by weight platinum. In order to maintain the activity of the catalyst, there is a continual make-up of 42 g/h of carbon tetrachloride in the charge, which corresponds to a content of 500 ppm by weight. The isomerization reaction is carried out under an average pressure of 30 bars and at a temperature of 140° C. (inlet) to 160° C. (outlet). Under these conditions, the hydrocarbon effluent of the isomerization reactor contains approximately 13.9 mole % $nC_5$ and 4.6 mole % $nC_6$.

The complete effluent of the isomerization reactor is supplied directly by the line 4 to the stabilizing column $S_2$ (FIG. 3) operating under a pressure of 15.5 bars, a temperature of approximately 200° C. to the reboiler and 30° C. to the reflux flask. At the head and using a condenser a phase separator, and the line 12' purging takes place of a gaseous mixture essentially containing hydrogen. The bottom fraction of the stabilizing column 5 containing less than 0.5 ppm by weight of HCl is drawn off in the vapour phase level from the reboiler by the line 6 and is mixed with part (approximately 8 kg/h) of the head effluent of the column D1 arriving by the line 7, and the resultant mixture, preheated to a temperature of 300° C., is introduced in the vapour phase at the bottom of the adsorber A by the line 8. The latter operates under an average pressure of 15 bars and an average temperature of 300° C. for the duration of the adsorption phase, which lasts approximately 6 minutes. The 4 m high, 12.7 cm internal diameter adsorber contains 38 kg of zeolite 5A in the form of 1.6 mm diameter extrudates. On leaving the adsorber recovery takes place by the line 9 and with an average flow rate of approximately 77 kg/h of an isomerate containing less than 1 mole % of normal $C_5/C_6$ paraffins and having a RON of 88 to 88.5, which constitutes the end product.

Simultaneously the adsorbent bed contained in the adsorber D, having the same dimensions as adsorber A and which was used in a preceding adsorption phase, is now in the desorption phase. The latter is carried out by lowering the pressure from 15 to 2 bars and injecting at the top of the reactor at a temperature of 300° C. and with an average flow rate of 31.8 kg/h, the remainder of the $iC_5$-rich head effluent of column D1 (line 10). The temperature of the adsorbent bed is close to 300° C. throughout the desorption phase, which lasts 6 minutes. The desorption effluent drawn off at the bottom of the adsorber D contains approximately 27 mole % of $nC_5$ and 7.5 mole % of $nC_6$. It is recycled by the line 11 to the distillation column D1.

At the end of each 6 minute period, the adsorbers A and D are switched by means of a set of valves, so as to operate alternately in the adsorption and desorption phases.

The process was performed continuously for 45 days under the conditions described hereinbefore and led to an isomerate with a research octane number (RON) between 88 and 88.5.

We claim:

1. A process for the isomerization of n-paraffins into isoparaffins in a charge consisting essentially of a $C_5/C_6$ fraction, comprising:

a deisopentanization stage (D1), comprising feeding said charge to a deisopentanization distillation column and also feeding to said deisopentanization column an effluent from a desorption stage (4), withdrawing a bottoms residue and an overhead from said column, partly condensing said overhead to form a distillate and recycling part of the distillate to the head of said column as liquid reflux, and vaporizing non-recycled distillate to form an isopentane-rich gaseous flow;

an isomerization stage (2) comprising feeding said bottom residue from the deisopentanization stage into an isomerization reactor (1), withdrawing an effluent from said stage and feeding the effluent into a phase separator to form a vapor phase and a crude isomerate liquid phase, recycling the vapor phase to the isomerization reactor, and vaporizing the crude isomerate;

an adsorption stage (3), comprising providing an adsorber containing a molecular sieve able to retain n-paraffins; supplying to said adsorber an ascending vapor flow comprising the resultant vaporized crude isomerate and the resultant isopentane-rich vaporized, non-recycled fraction of the distillate from the deisopentanization stage; and collecting from said adsorber an isomerate freed from n-paraffins, said adsorber being under pressure; and a desorption stage (4), alternating with the adsorption stage (3), comprising lowering the pressure in the adsorber, passing through the molecular sieve a gaseous flow from the overhead of the deisopentanization stage, withdrawing effluent from said desorption stage and supplying said effluent to the deisopentanization stage.

2. A process according to claim 1, wherein said $C_5/C_6$ fraction is a light naphtha.

3. A process according to claim 1, wherein the deisopentanization stage (1) is conducted at a pressure of 1 to 2 bars, between a bottom temperature of 40° to 90° C. and a head temperature of 20° to 60° C., so that the distillate contains 5 to 20 mole % of n-pentane and the residue contains 5 to 15 mole % of isopentane.

4. A process according to claim 3, wherein the overhead of the deisopentanization stage is compressed to a pressure of 5 to 6 bars and said condensing of the overhead evolves heat and transferring said heat to a reboiler at the bottom of the deisopentanization column.

5. A process according to claim 4, wherein in the isomerization stage, the residue of the deisopentanization stage, in the presence of hydrogen, is passed onto a catalyst consisting essentially of a zeolite containing at least one metal chosen from among those of group VIII of the periodic classification of elements or a platinum-impregnated chlorinated alumina, under a pressure of 5 to 30 bars and at a temperature of 140° to 300° C.

6. A process according to claim 5, wherein in the desorption stage (4), the pressure is lowered to a value below 5 bars and the iospentane-rich gaseous flow taken from the distillate of stage (1) is raised to a temperature of 250° to 350° C., and is passed through the adsorber in a proportion corresponding to 1 to 2 moles of isopentane per mole of n-paraffins to be desorbed for a period of 2 to 10 minutes.

7. A process according to claim 6, further comprising feeding the effluent of the isomerization stage (2) into a stabilizing column at a pressure of 10 to 20 bars, removing at the head of said stabilizing column light products and any hydrochloric acid from the isomerization catalyst, withdrawing from the bottom an effluent and supplying said effluent to the adsorption stage (3).

8. A process according to claim 3, wherein in the isomerization stage, the residue of the deisopentanization stage, in the presence of hydrogen, is passed onto a catalyst consisting essentially of a zeolite containing at least one metal chosen from among those of group VIII of the periodic classification of elements or a platinum-impregnated chlorinated alumina, under a pressure of 5 to 30 bars and at a temperature of 140° to 300° C.

9. A process according to claim 3, wherein in the desorption stage (4), the pressure is lowered to a value below 5 bars and the iospentane-rich gaseous flow taken from the distillate of stage (1) is raised to a temperature of 250° to 350° C., and is passed through the adsorber in a proportion corresponding to 1 to 2 moles of isopentane per mole of n-paraffins to be desorbed for a period of 2 to 10 minutes.

10. A process according to claim 1, wherein the overhead of the deisopentanization stage is compressed to a pressure of 5 to 6 bars and said condensing of the overhead evolves heat, and transferring said heat to a reboiler at the bottom of the deisopentanization column.

11. A process according to claim 10, wherein in the desorption stage (4), the pressure is lowered to a value below 5 bars and the iospentane-rich gaseous flow taken from the distillate of stage (1) is raised to a temperature of 250° to 350° C., and is passed through the adsorber in a proportion corresponding to 1 to 2 moles of isopentane per mole of n-paraffins to be desorbed for a period of 2 to 10 minutes.

12. A process according to claim 11 wherein in the isomerization stage, the residue of the deisopentanization stage, in the presence of hydrogen, is passed onto a catalyst consisting essentially of a zeolite containing at least one metal chosen from among those of group VIII of the periodic classification of elements or a platinum-impregnated chlorinated alumina, under a pressure of 5 to 30 bars and at a temperature of 140° to 300° C.

13. A process according to claim 12, wherein in the desorption stage (4), the pressure is lowered to a value below 5 bars and the iospentane-rich gaseous flow taken from the distillate of stage (1) is raised to a temperature of 250° to 350° C., and is passed through the adsorber in a proportion corresponding to 1 to 2 moles of isopentane per mole of n-paraffins to be desorbed for a period of 2 to 10 minutes.

14. A process according to claim 1, wherein the absorption stage (3) is conducted at a temperature of 200° to 400° C., at a pressure of 10 to 40 bars, and for 2 to 10 minutes.

15. A process according to claim 1, wherein in the desorption stage (4), the pressure is lowered to a value below 5 bars and the isopentane-rich gaseous flow taken from the distillate of stage (1) is raised to a temperature of 250° to 350° C. and is passed through the adsorber in a proportion corresponding to 1 to 2 moles of isopentane per mole of n-paraffins to be desorber for a period of 2 to 10 minutes.

16. A process according to claim 1, further comprising feeding the effluent from the isomerization stage (2) into a stabilizing column at a pressure of 10 to 20 bars, removing at the head of said stabilizing column light products and any hydrochloric acid from the isomerization catalyst, withdrawing from the bottom an effluent and supplying said effluent to the adsorption stage (3).

17. An isomerate obtained by a process according to claim 1.

* * * * *